US011130666B2

(12) United States Patent
Carter et al.

(10) Patent No.: US 11,130,666 B2
(45) Date of Patent: Sep. 28, 2021

(54) WINE OPENER WITH INTERIOR THREADS

(71) Applicants: Christopher Kirk Carter, Longmont, CO (US); Nicholas Robert Pierce, Evergreen, CO (US)

(72) Inventors: Christopher Kirk Carter, Longmont, CO (US); Nicholas Robert Pierce, Evergreen, CO (US)

( * ) Notice: Subject to any disclaimer, the term of this patent is extended or adjusted under 35 U.S.C. 154(b) by 0 days.

(21) Appl. No.: 16/814,876

(22) Filed: Mar. 10, 2020

(65) Prior Publication Data

US 2020/0290856 A1 Sep. 17, 2020

Related U.S. Application Data

(60) Provisional application No. 62/816,742, filed on Mar. 11, 2019.

(51) Int. Cl.
*B67B 7/06* (2006.01)

(52) U.S. Cl.
CPC ..... *B67B 7/063* (2013.01)

(58) Field of Classification Search
CPC ..... B67B 7/063
USPC ..... 81/3.4
See application file for complete search history.

(56) References Cited

U.S. PATENT DOCUMENTS 5,010,790 A * 4/1991 Yen ..... B67B 7/02 81/3.35
2006/0070241 A1* 4/2006 Miller ..... A47J 23/00 30/113.1

* cited by examiner

*Primary Examiner* — David B. Thomas
*Assistant Examiner* — Thomas Raymond Rodgers

(57) ABSTRACT

The industry-standard corkscrew has numerous flaws resulting in broken corks—even in the hands of a professional. The present invention is a radical departure from the traditional corkscrew apparatus. The opener generally consists of the handle and an internally threaded half-pipe. The half-pipe slides between the cork and the bottle, wherein the series of threads engage the cork. Rotating the handle causes the threads to bore deeper into the neck of the bottle until the handles meets the lip of the bottle, and then lift the cork out of the bottle until it disengages and falls away from the opener. It should be appreciated that the elegance of the opener resides in its simplicity.

7 Claims, 9 Drawing Sheets

WINE OPENER WITH INTERIOR THREADS

CROSS-REFERENCE TO RELATED APPLICATION

This application claims the benefit of U.S. Provisional Application No. 62/816,742, filed Mar. 11, 2019.

BACKGROUND

The popularity of wine shows no sign of slowing down. U.S. wine sales for 2018 were in excess of $70 billion and that number has increased year over year for the past 25 years. Worldwide it is estimated that 31.4 billion bottles of wine are bought and sold each year.

Despite the many advances in the wine production industry, the method of using a cork stopper to seal a bottle has remained relatively unchanged for thousands of years. Some wine producers have transitioned from wooden corks to synthetic corks, but the general premise of placing a compressed cylinder deep into the neck of a bottle has stayed the same. It, therefore, follows that prior to consumption the end consumer faces the challenge of removing the cork.

Built off the traditional corkscrew, the industry standard wine opener, commonly known as the waiter's friend, is used by winemakers, sommeliers, waiters, and the consumers. The waiter's friend is relatively compact compared to other products in the market, but it has several major flaws. The waiter's friend requires that a corkscrew is first driven into the cork to a proper depth such that a notched lever can rest on the lip of the bottle to aid in pulling the cork. It is an awkward and intimidating tool for the uninitiated and even wine professionals routinely break corks in the bottle while using it. Mechanically, it relies on moving parts to create a leverage point on the lip of the bottle resulting in uneven and non-perpendicular forces pulling up on the cork. Lastly, once the cork is removed from the bottle, it remains on the end of the corkscrew and must be removed for the consumer to inspect and before the tool can open the next bottle.

The invention disclosed herein presents an improved alternative to the traditional corkscrew or waiter's friend to address the challenge of removing a cork.

SUMMARY OF THE INVENTION

The present invention, herein simply referred to as the opener, is a radical departure from the traditional corkscrew apparatus used to remove a cork from a bottle. The opener generally consists of two parts, a handle and an internally threaded half-pipe. In the preferred embodiment, the half-pipe is perpendicular to the handle, has an arc angle of roughly 180 degrees, and a diameter equivalent to the mouth of the corked bottle. The half-pipe slides between the cork and the inner wall of the bottle, wherein the series of internal threads engage the cork. By twisting the handle, the interaction between the internal threads and the exterior cork surface cause the half-pipe of the opener to bore deeper into the neck of the bottle.

The half-pipe will continue to drive into the bottle to a depth until the lip of the bottle reaches the handle. When the handle reaches the lip of the bottle, the internal threads will then begin to lift the cork out of the bottle. By continuing to twist the handle, the cork will rise until it disengages from the bottle and falls away from the opener.

It should be appreciated that the elegance of the opener resides in its simplicity, however, also disclosed are alternative enhancements and variations of the tool.

DETAILED DESCRIPTION OF THE INVENTION

The present invention, herein simply referred to as the opener 100, is a radical departure from the traditional corkscrew apparatus to remove a cork from a bottle. Disclosed are both the preferred embodiments of the apparatus, as well as the method of use by example. It should be appreciated that the elegance of the opener resides in its simplicity, however, also disclosed are alternative embodiments, enhancements, and variations of the tool.

Figure 1:
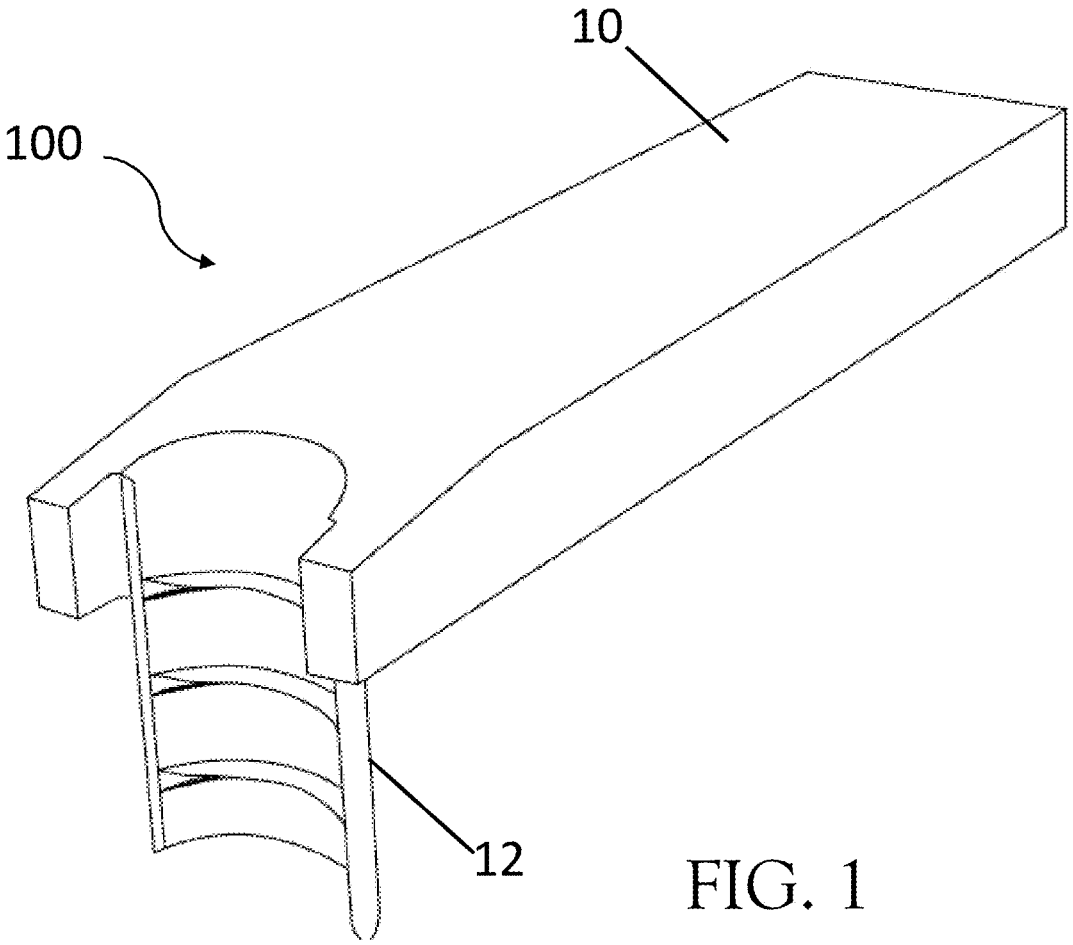
FIG. 1 shows an upper isometric view of the wine opener.

As shown in FIG. 1, the opener generally consists of two parts, a handle 10, and a spoon 12 which is positioned at the distal end of the handle. In the most basic form, the handle 10 provides a simple lever by which to rotate the device around a cylindrical axis extending from the center of the cork 24. As an alternative embodiment, the spoon may be positioned at an intermediate section of the handle. The spoon 12 generally comprises an internally threaded half-pipe or semi-cylindrical pipe with an arc angle 18 of roughly 180 degrees, and a diameter equivalent to the opening of the intended corked bottle. A standard 750 ml bottle of wine, as an example, has a finished opening at top of the bottle of 0.75 inches or 18.5 mm. In the preferred embodiment, the handle 10 is perpendicular to the longitudinal axis of the half-pipe.

Figure 2:
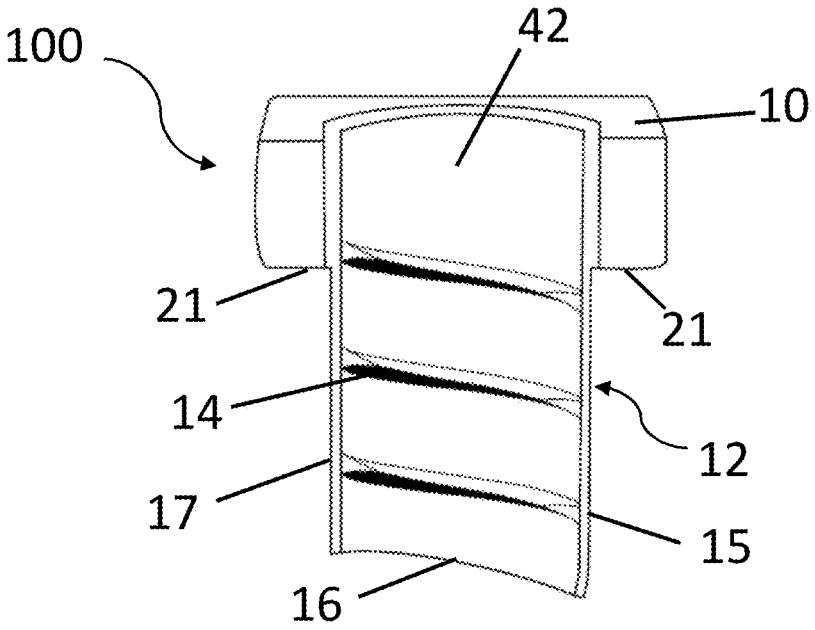
FIG. 2 shows a front view of the wine opener.

FIG. 2 is a front view of the opener 100. A shoulder 21 is formed around the edge of the spoon 12 where it coincides with the bottom of the handle 10. The spoon 12 has an inner wall 42 defined by an inner diameter, an outer wall 43 defined by an outer diameter, a wall thickness defined as the space between the surface of the inner wall 42 and outer wall 43, a plurality of internal threads 14, a leading edge 15, trailing edge 17, and a wedging edge 16. The throat length of the spoon 16 is defined as the distance from the wedging edge 16 to the shoulder 21.

The inner wall 42 is the surface of the spoon 12 configured to come into contact with the cylindrical surface of the cork 24. The outer wall 43 is the surface of the spoon 12 configured to come into contact with the inner surface of the bottle neck 28. In the preferred embodiment, the wall thickness is minimized such that the spoon may easily wedge between the bottle 22 and the cork 24. To aid in this initial process, the wedging edge 16 may be tapered relative to the general wall thickness of the spoon 12 allowing this wedging edge 16 to be introduced between the bottle 22 and cork 24 prior to the thread 15 engagement. In a similar manner, the leading edge 15 and/or the trailing edge 17, may also be tapered relative to the general wall thickness. In addition, the wedging edge 16 may employ various geometries such as the downward edge shown in FIG. 2, where the leading edge 15 is longer than the trailing edge 17, an upward-angle edge, where the leading edge 15 is shorter than the trailing edge 17, or a rounded edge that generally bows towards the middle of the spoon 12.

Figure 3A:
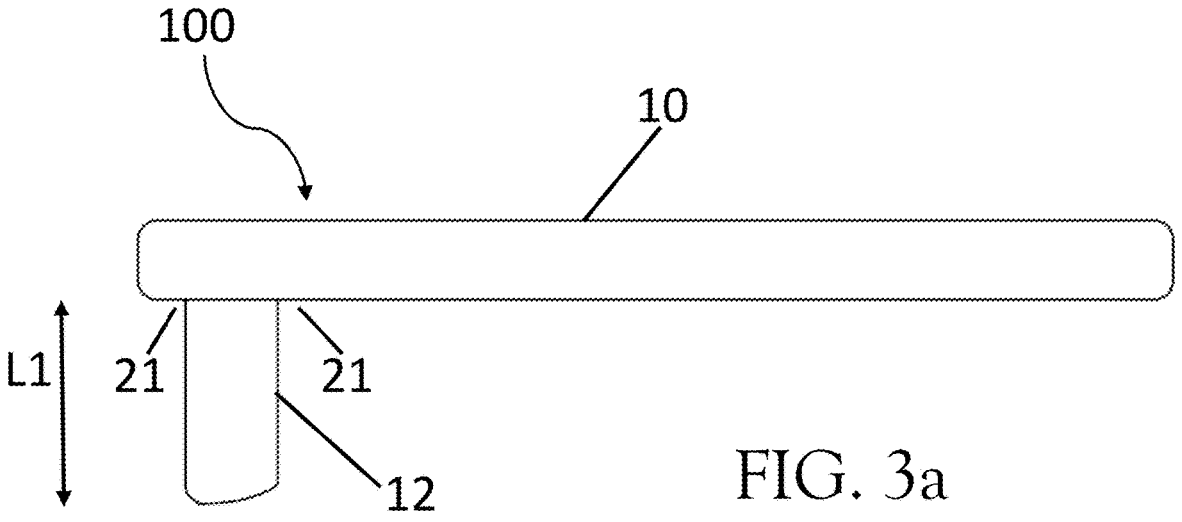
FIGS. 3*a* and 3*b* show a side view of the wine opener with various geometries.
Figure 3B:
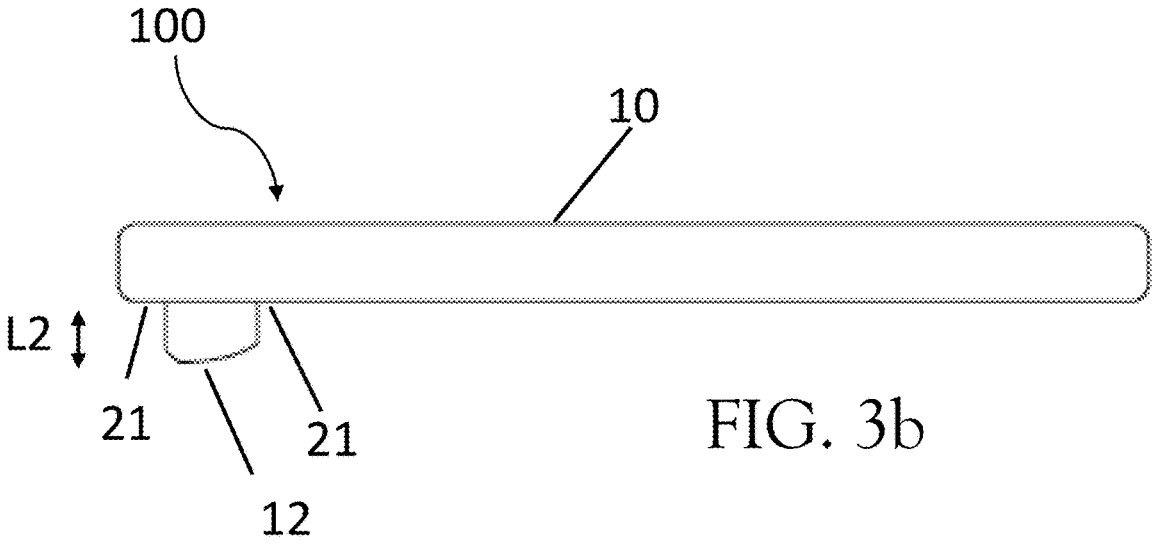

As shown in FIGS. 3*a* and 3*b*, the throat length is shown as L1 and L2 and may vary as well as the corresponding number of threads 14. The throat length functionally defines the depth to which the spoon will drive around the cork prior pulling the cork out of the bottle.

Figure 4:
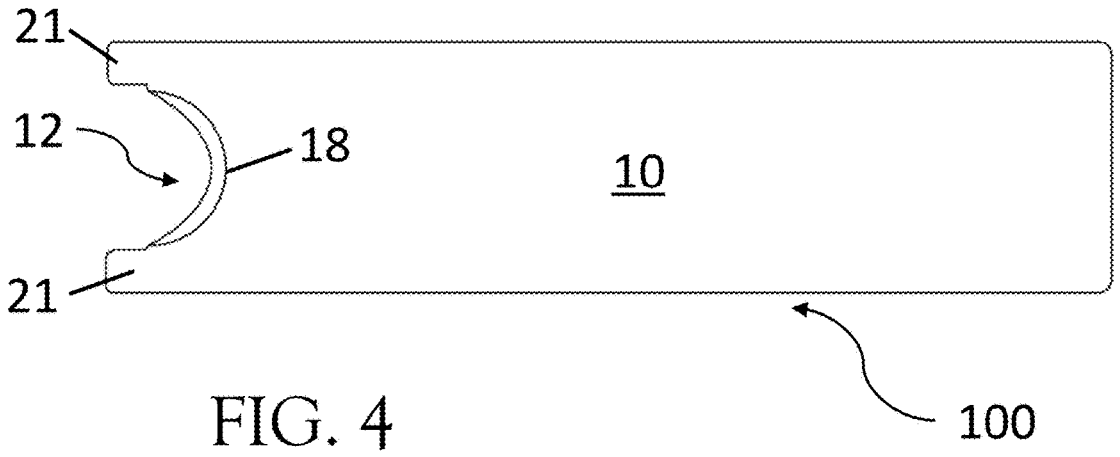
FIG. 4 shows a bottom view of the wine opener.

As shown in FIG. 4, the spoon 12 is preferably inset some distance from the distal end of the handle 10. Here, the handle 10 extends beyond the leading and trailing edge 15 and 17 of the spoon 12 to provide an extension of the shoulder 21 on each side of the spoon 12. The shoulder provides extra surface area to rest against the bottle lip 26.

The arc angle 18 of the spoon 12 is shown in FIG. 4 and defines the cross-sectional geometry of the inner wall 42 and thus the open face section of the spoon 12 opposite the inner wall 42. In the preferred embodiment, it is desirable for the cork 24 to fall away from the opener 100 after extraction. To accomplish this, the arc angle 18 of the spoon is defined as being between 65 degrees and 190 degrees. In an alternative embodiment, the arc angle may exceed 190 degrees to hold the cork 24 within the spoon 12 after extraction.

Figure 5A:
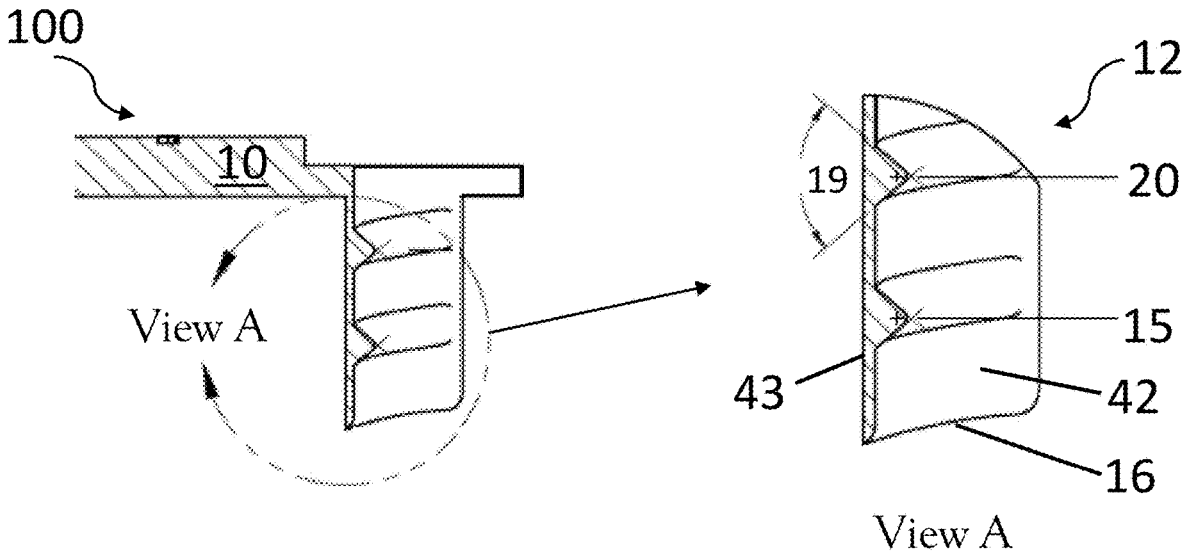
FIGS. 5*a* and 5*b* shows a detailed view of variations of the threaded member.
Figure 5B:
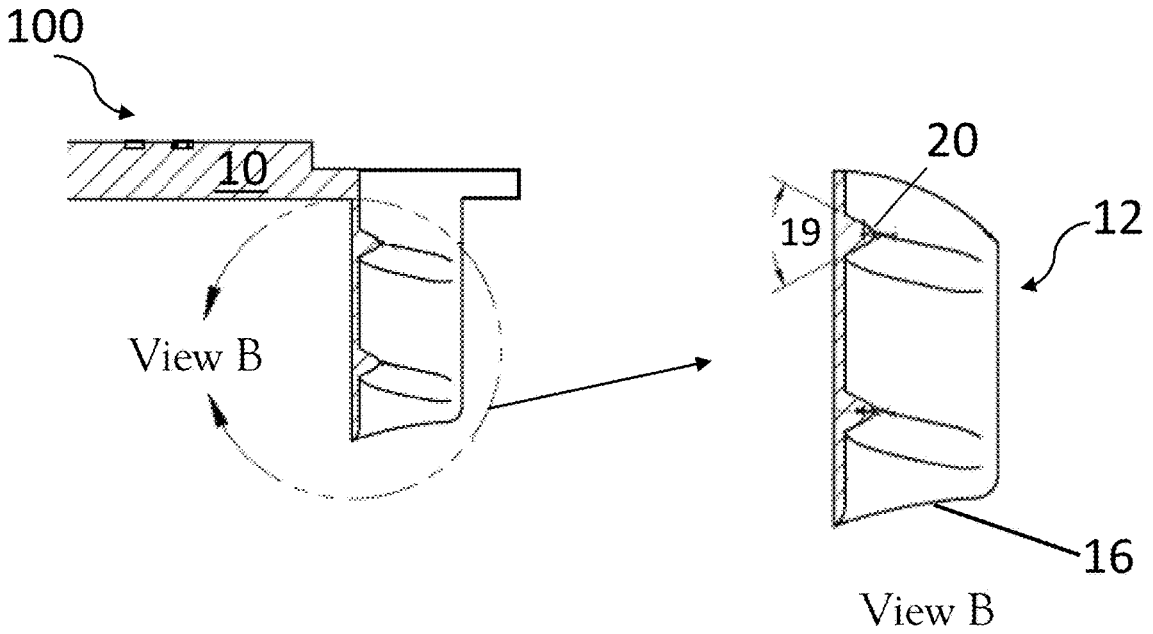

FIGS. 5*a* and 5*b* show detailed cross-sectional views of the spoon with slight variations including thread pitch, geometry, height, and orientation. These variations present a multitude of methods for optimization of the opener and that the thread may depend upon the cork material, user preference, or other perimeters.

Along the face of the inner wall 42 on both views are a series of open threads 14 positioned at an angle offset from the horizontal axis defined by the bottom of the handle 10. In the preferred embodiment, the threads 14 are parallel to one another, however, they need not have identical depth or pitch. To illustrate possible variations, View A and View B show variations of thread angle 19 where View A has a thread angle 19 of 80° and View B has a thread angle 19 of 55°. Another variation in View A and B are differences in the thread crest 20 where View A comes to a sharp point and View B comprises a rounded or beveled shape. The idea behind the sharp point thread is to purposefully cut into the cork with a sharp thread. The beveled shape of the thread must be a small enough angle that the thread cleanly cuts into the cork without tearing. The benefit of a thread that cuts into the cork is that additional compression of the cork won't occur, and thread engagement can be ensured. The rounded edge on the threads is essential in compressing the cork without damage and this thread works by allowing the non-rigid material of the cork to form around the thread.

As a further extension of the optimization concepts presented, it may be beneficial to have shallow lower threads to initiate the engagement of the cork, and deeper threads higher on the inner wall 42 to aid in pulling the cork. Threads are most effective near the lip of the bottle, primarily due to the neck angle and the compression of the cork. The spoon 12 must compress the cork 24 into its shape to properly engage the threads; however, in the lower regions of the neck, the cork has additional room on the sides to expand, and although funneled into the spoon, the compression and subsequent thread engagement are not as strong.

Finally, another variation between View A and B illustrates that the threads may be mirrored to accommodate a right- or left-handed opener 100 where View A would require a counter-clockwise rotation and View B would require a clockwise rotation to remove a cork.

Figure 6A:
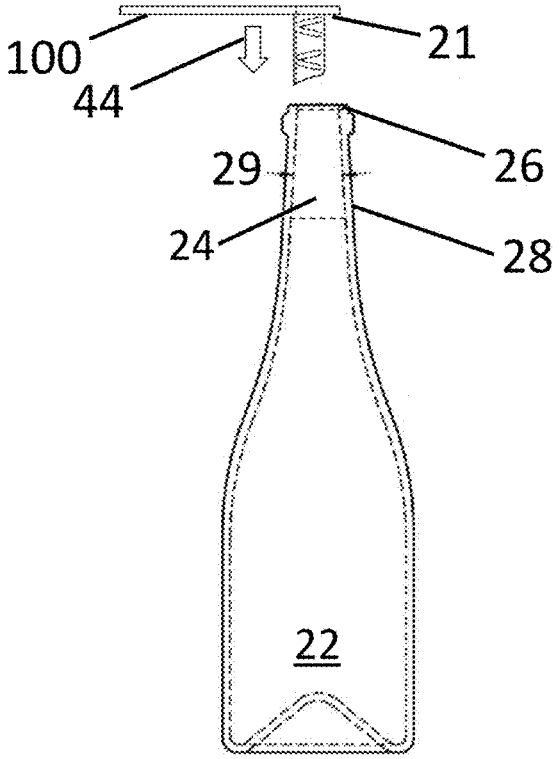
FIGS. 6*a*, 6*b*, 6*c*, and 6*d* illustrate the process of using the opener to remove a cork from a bottle.
Figure 6B:
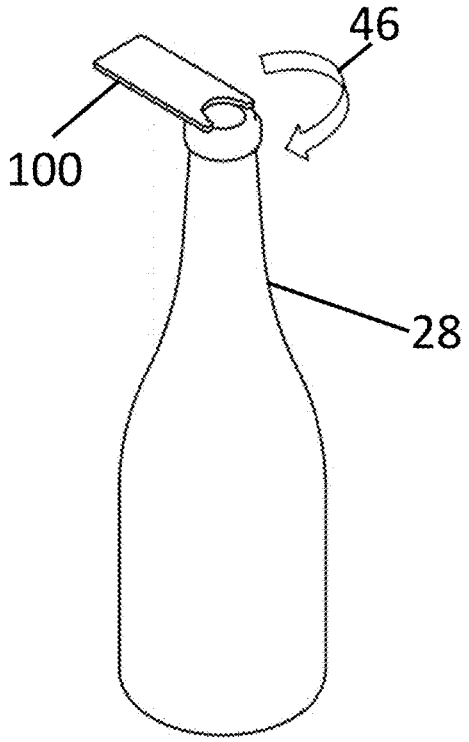
Figure 6C:
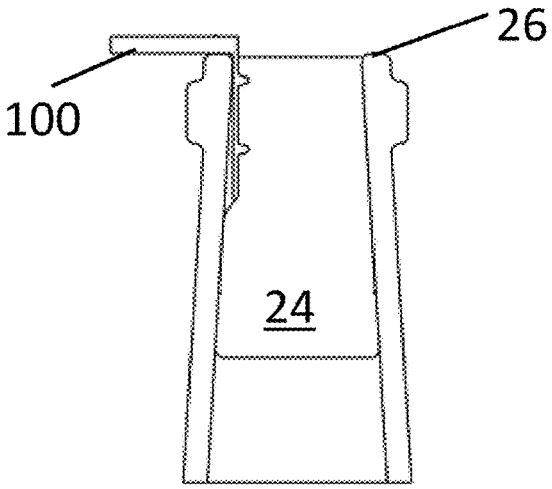

Method of Use:

The following description along with steps illustrated in FIGS. 6*a*, 6*b*, 6*c*, and 6*d*, show how the opener 100 is intended to operate. As shown in FIG. 6*a*, a bottle 22 is initially presented with a cork 24 stopper positioned within the bottle neck 28 and flush to the bottle lip 26. Utilizing a downward force 44 the wedging edge 16 of the spoon 12 is slid between the cork 24 and the inner surface of the bottle lip 26 until the series of internal threads 14 on the inner face 42 of the spoon 12 engage the cork 24. By applying a rotational force 46 upon the handle 10, as shown in 6*b*, the interaction between the internal threads 14 and the cylindrical surface of the cork 24 cause the spoon 12 of the opener 100 to bore deeper into the neck of the bottle 28. The spoon 12 will continue to drive into the bottle to a depth where the shoulder 21 reaches the bottle lip 26 reaches the shoulder 21 of the opener 100. This position is illustrated both in a macro view of FIG. 6*b* and as a detailed cross section of FIG. 6*c*.

Figure 6D:
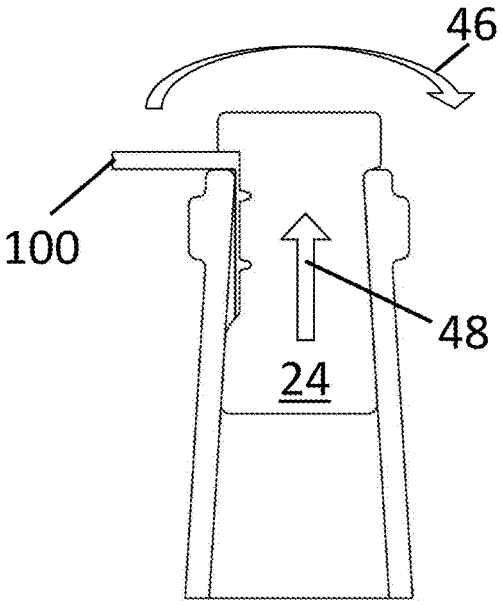

As shown in FIG. 6*d*, with the shoulders 21 resting on the bottle lip 26, any additional rotational force 46 will cause the internal threads 14 to lift 48 the cork 24 out of the bottle 22. By continuing to twist the handle, the cork 24 will rise until it disengages from the bottle and falls away from the opener 100.

Figure 7:
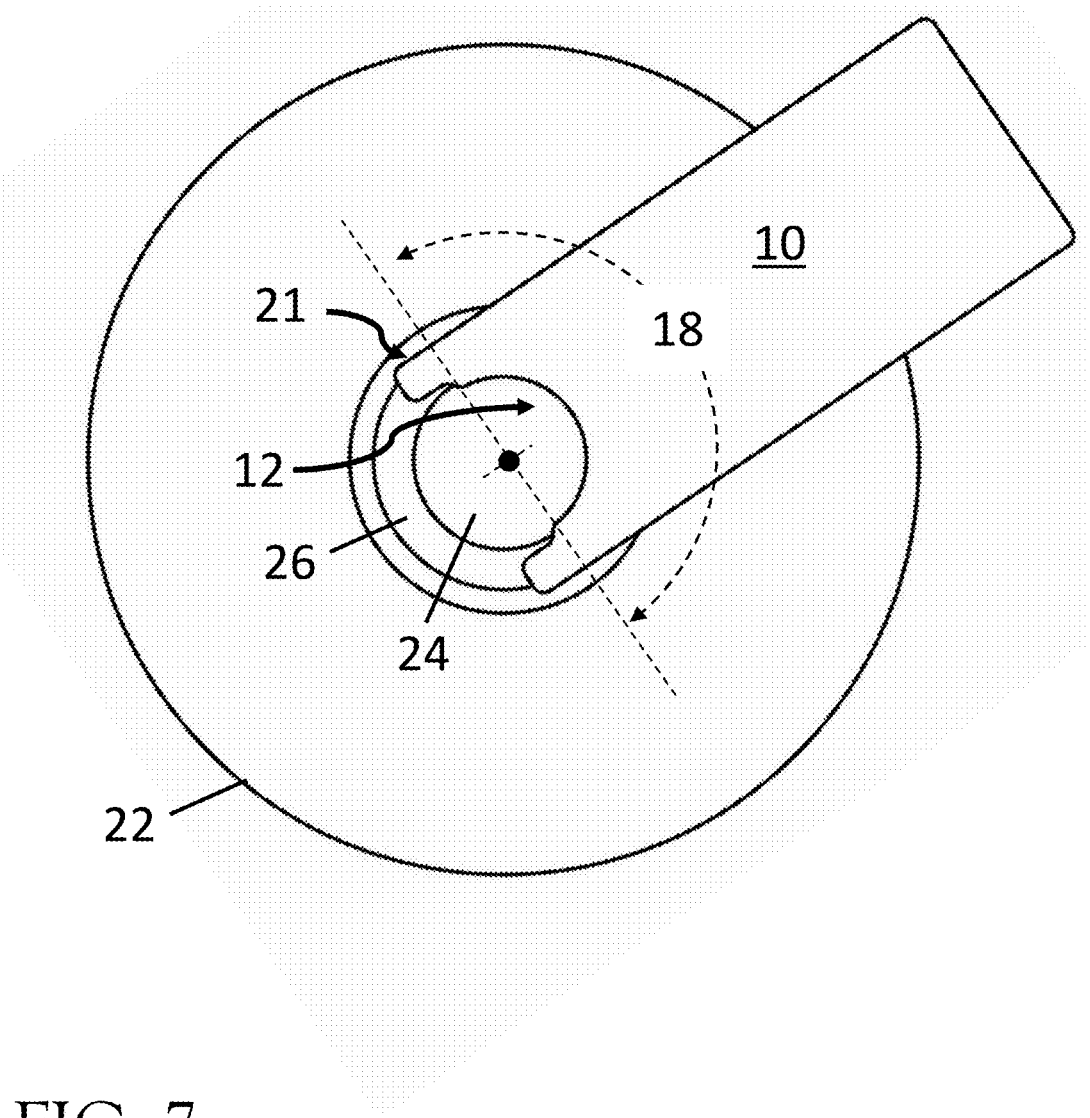
FIG. 7 is a top view of the opener engaged with a bottle.

FIG. 7 provides a top view of the process, tool alignment based on a central axis, and physical characteristics such as arc angle 18, and the shoulder 21 and bottle lip 26 interface.

ALTERATIVE EMBODIMENTS

The opener 100 may be constructed as a single die-cast employing any number of materials (plastics, metals, etc.) Alternatively, the opener 100 may be constructed as two separate pieces. A two-piece design may allow different manufacturing techniques and non-similar materials, such as a metal spoon and plastic handle.

Figure 8:
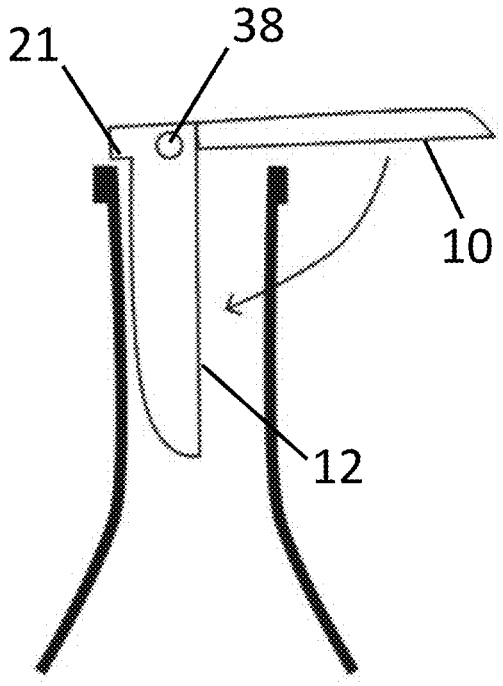
FIG. 8 shows a side view of a foldable wine opener in the open position.
Figure 9:
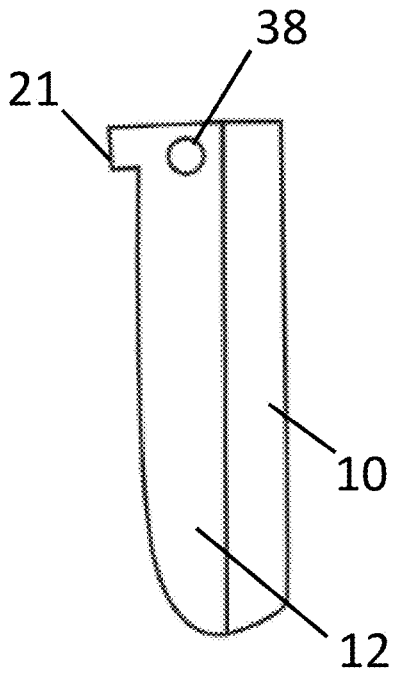
FIG. 9 shows a side view of a foldable wine opener in the closed position.
Figure 10:
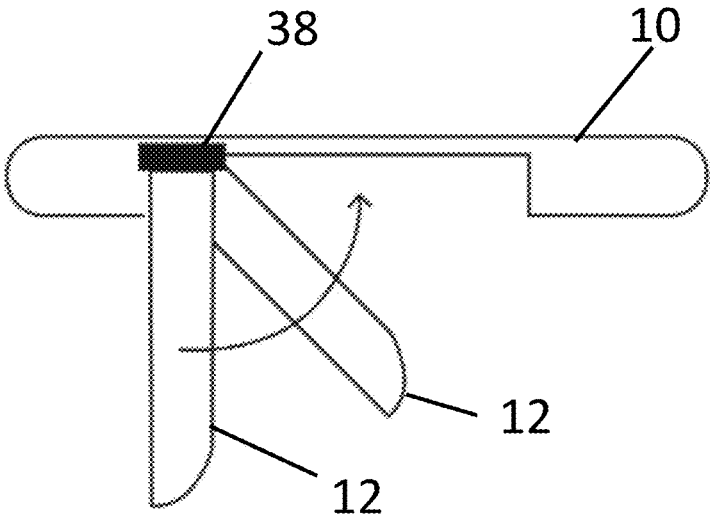
FIG. 10 shows a side view of a foldable wine opener with an intermediate hinge.
Figure 11:
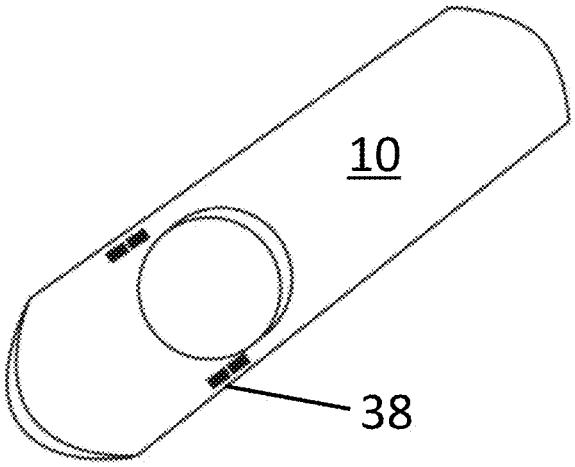
FIG. 11 shows a top view of a foldable wine opener with an intermediate hinge.

As a two-piece design, a hinge 38 may be employed to make an opener that is capable of folding. FIGS. 8 and 9 provide a side view of this opener 100 in the open and closed position respectively and FIG. 8 shows a top view of the opener 100 in the open position. In this configuration, the inner face 42 of the spoon 12 is shown facing towards the handle 10. To minimize space, some portion of the handle 10 may reside within the open channel opposite the inner face 42 when in the closed position. As a similar design, FIGS. 10 and 11 show a side view and a top view respectively of a two-piece design wherein a hinged joint 38 is configured near an opening located intermediately within in the handle 10 to allow the spoon 12 to fold into the handle 10 and fully extending the shoulder 21 to form a ring which may be employed to hold the cork after removal.

Figure 12:
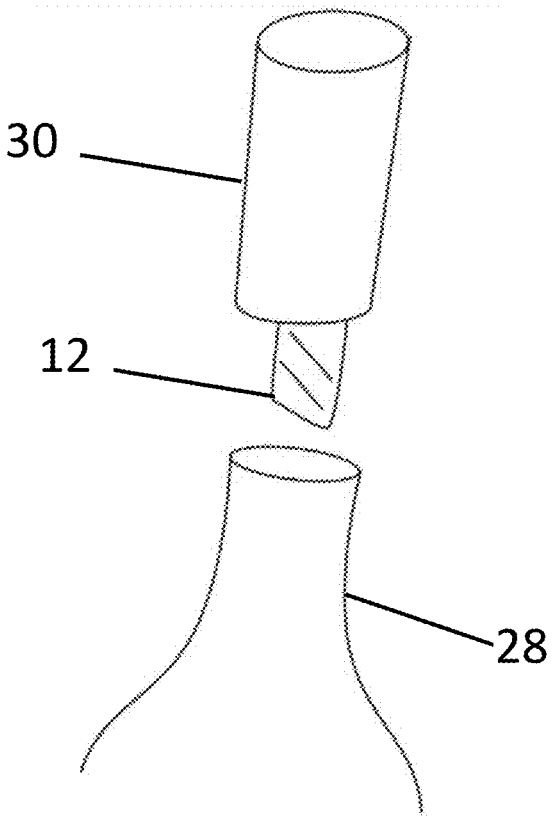
FIG. 12 shows an embodiment with a vertical handle.

FIG. 12 shows the longitudinal axis of the spoon 12 generally congruent with the longitudinal axis of the handle 10. In this configuration, the handle 10 may have an internal cavity to receive the cork 24 and the shoulder 21 may rotate freely while the spoon 12 and handle 10 are fixed to one another.

Figure 13:
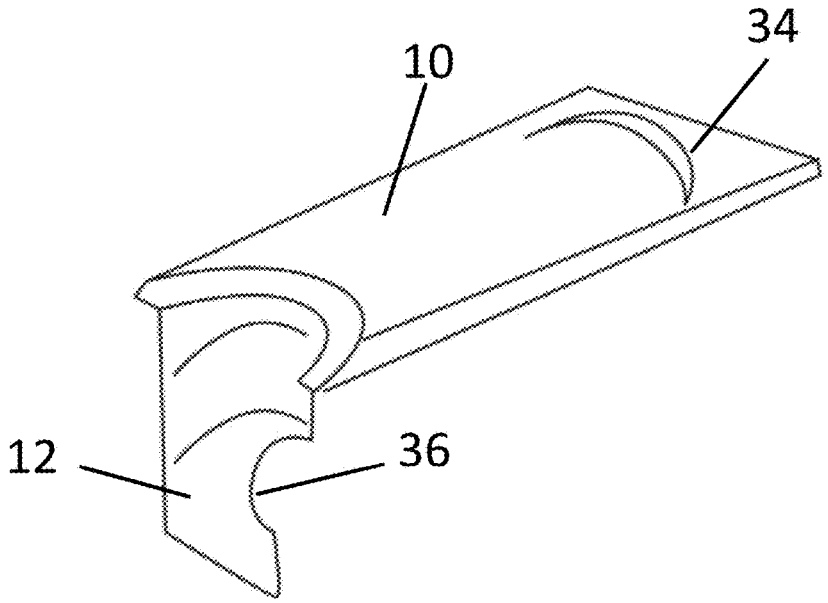
FIG. 13 shows an upper isometric view of the wine opener with an integrated bottle opener and foil cutter.
Figure 14:
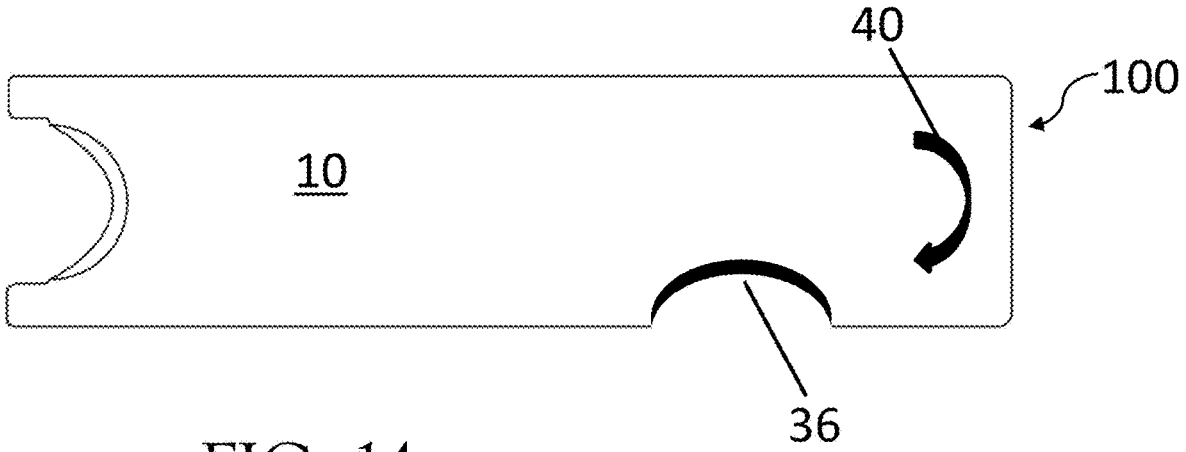
FIG. 14 shows a top view of the wine opener with a foil cutter and indicia integrated in the handle.

Additional features may be incorporated into the opener 100 to extend the functionality. As an example, FIG. 13 shows the handle 10 configured with a bottle cap opener 34 integrated at the distal end of the handle and a foil cutter 36 crafted into the spoon 12. FIG. 14 shows how a foil cutter 36 may be integrated into the handle 10. In addition, indicia 40 may be placed on the handle such as instructions or advertisements.

What is claimed is:

1. An opener for removing a cylindrical cork from a bottle consisting of:

a handle and a single semi-cylindrical pipe section, wherein the semi-cylindrical pipe section is defined by an arc angle between 65° and 190°, and includes an upper end, a lower end, an interior wall upon which a plurality of threads are disposed, and an exterior wall, and wherein the lower end and interior wall are configured to be inserted between the cork and the bottle; and wherein the handle is attached to the exterior wall of the semi-cylindrical pipe section.

2. The opener of claim 1, wherein the semi-cylindrical pipe section is further defined as having a radius approximately equivalent to the radius of the cork.

3. The opener of claim 2, wherein the semi-cylindrical pipe section has a tapered edge along the lower end.

4. The opener of claim 3, wherein the lower end includes a leading edge and a trailing edge, and wherein the leading edge and trailing edge are dissimilar lengths.

5. The opener of claim 1 wherein, the handle is perpendicular to the axis of the semi-cylindrical pipe section.

6. The opener of claim 1, wherein the arc angle of the semi-cylindrical pipe section is approximately 180°.

7. The opener of claim 1, wherein the handle and the semi-cylindrical pipe section are constructed as a unitary body formed by a die cast operation.

* * * * *